US006812825B1

(12) United States Patent
Volk

(10) Patent No.: US 6,812,825 B1
(45) Date of Patent: Nov. 2, 2004

(54) TIMED ALERT DEVICE FOR VEHICLES

(76) Inventor: William Volk, 97 Highview Dr., Wading River, NY (US) 11792

( * ) Notice: Subject to any disclaimer, the term of this patent is extended or adjusted under 35 U.S.C. 154(b) by 12 days.

(21) Appl. No.: 10/267,228

(22) Filed: Oct. 9, 2002

(51) Int. Cl.[7] ..... G08B 1/00

(52) U.S. Cl. ..... 340/309.16; 340/425.5; 340/457.4; 340/461; 368/10; 368/108

(58) Field of Search ..... 340/309.16, 425.5, 340/457, 457.4, 461, 540, 691.1, 691.6, 693.1, 693.2, 309.7; 368/10, 107, 108, 71, 72, 3, 62, 76–78, 223–235

(56) References Cited

U.S. PATENT DOCUMENTS 2,656,817 A 10/1953 Jones
3,763,488 A * 10/1973 Klasing ..... 340/384.71
4,138,964 A 2/1979 Fujita
4,862,393 A 8/1989 Reid et al.
5,819,201 A 10/1998 DeGraaf
5,910,931 A 6/1999 Pettyjohn
6,026,060 A * 2/2000 Rothschild et al. ..... 368/10
6,114,953 A 9/2000 Martin
6,359,570 B1 3/2002 Adcox et al.

* cited by examiner

*Primary Examiner*—Nina Tong
(74) *Attorney, Agent, or Firm*—Collard & Roe, P.C.

(57) ABSTRACT

A timed alert device for vehicles having an electronic timer that counts down a specified time period. An audible alert coupled to the electronic timer projects a sound when the electronic timer has reached a prescribed time. A first actuating element is coupled to the electronic timer which deactivates the audible alert when depressed. A power source is coupled to and supplies power to the electronic timer. A visual alert illuminates when the electronic timer has reached a prescribed time. Depressing a second actuating element deactivates the visual alert.

10 Claims, 3 Drawing Sheets

FIG. 7
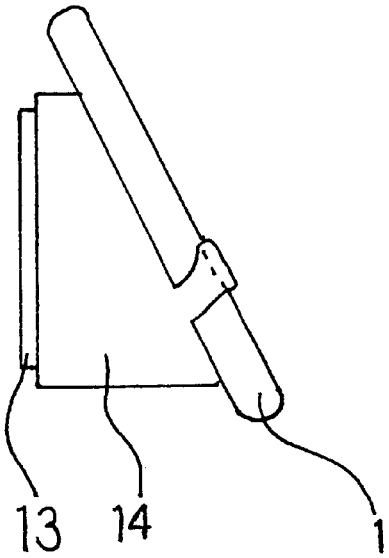
FIG. 8
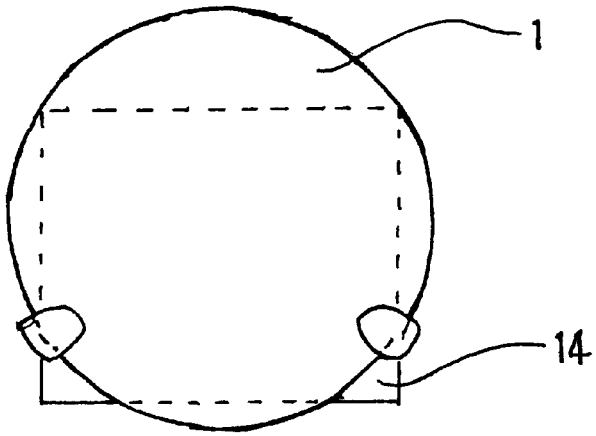
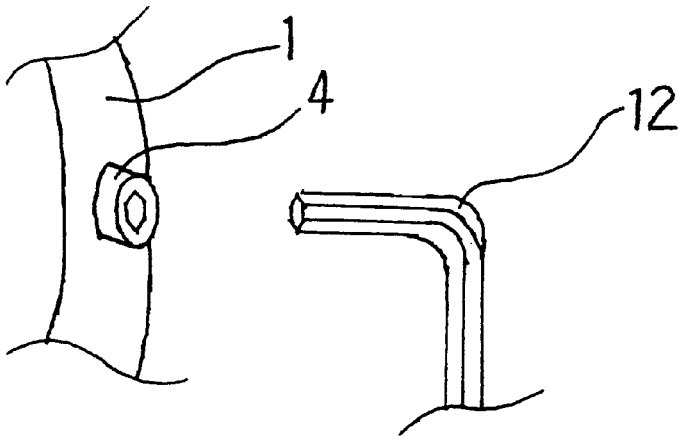
FIG. 9

TIMED ALERT DEVICE FOR VEHICLES

BACKGROUND

The invention relates to a timed alert device for vehicles. This timed alert device may be used to alert the driver of any upcoming events for the vehicle, such as inspection, registration or oil change. State law mandates that all vehicles that are registered and driven must have a valid inspection. Most states require a vehicle inspection once a year. The scope of the inspection can include the general condition of the vehicle as well as its emissions.

Inspection stickers indicate when the next inspection is due. These stickers face out from the vehicle so that they are easily read by law enforcement. A driver is most likely to think about the inspection of a vehicle while driving, however there is no reminder when inside the vehicle.

Several patents exist with the purpose of monitoring the systems of a vehicle and reminding a driver of information.

U.S. Pat. No. 4,138,964 discloses a vehicle service and inspection time indicating device. The device includes an integrating odometer enclosed within a meter case. It has an indicating element that is visually perceived by the driver.

U.S. Pat. No. 6,114,953 discloses an automotive accessory reminder device. The device fits on a vehicle key ring and includes an integrated processor which provides reminder information such as mileage or dates. The exterior surface of the device has a display area for displaying illuminated alphanumeric digits.

U.S. Pat. No. 5,819,201 discloses a navigation system with vehicle service information. The system has a display for service reminders.

U.S. Pat. Nos. 4,862,393 and 2,656,817 disclose oil change indicators which monitor oil temperature fuel flow and the volume of oil added to the engine to provide an indication of when the oil should be changed.

However, there exists no device that simply and effectively indicates to the driver that inspection is due or will soon be due. Additionally, there is no independently powered device that clocks a specific amount of time for warnings of inspection. Finally, there exists no device that provides separate audible and visual alerts after specified time periods.

SUMMARY

The timed alert device of the present invention is shaped as a timing disk that is affixed to the inside of a vehicle windshield, preferably adjacent to the inspection sticker. The disk has a programable computer chip, or electronic timer. At a prescribed time the device emits an audible alert, warning the driver that a vehicle event is due soon, such as inspection, registration, or oil change. This prescribed time would be approximately one month before the previous inspection expires. After a second prescribed time the device emits an orange or red visual alert that the driver can see, again indicating that inspection is due.

The audible alert may be a series of intermittent beeps. The visual inspection alert is a screen, preferably LCD, with an alphanumeric display, preferably the words "inspection due". The screen is backlit when the alert is activated. When not backlit, the words "inspection alert" blend into the background of the face, similar to an Indiglo light.

The device has two actuating elements disposed on its housing. The visual and audible alert are deactivated by depressing one of the actuating elements.

A first actuating element may be used to deactivate the audible alert, while a second actuating element may be used to deactivate the visual alert. In this embodiment the second actuating element would also reset the electronic timer. This second actuating element may be formed so that only a certified technician can deactivate the second alert with a special tool. Alternatively, the first actuating element may be used to deactivate both the audible alert and the visual alert and the second actuating element may be used only to reset the electronic timer.

The device and electronic timer can be powered by a small solar strip. The strip is disposed on the back of the device housing against the windshield permitting it to collect sunlight. The device can also be powered by a small watch-type battery.

After inspection the electronic timer is reset by depressing one of the actuating elements on the surrounding edge of the device.

A plastic mounting bracket can be fastened to the inside of the vehicle's windshield with an adhesive. The plastic mounting bracket can then house the timed alert device, and position the device so that it is tilted so the driver can see the visual alert.

The timed alert can be removable from the vehicle and is preferably made of plastic. The device can be used for other timed events such as registration renewal and oil changes.

BRIEF DESCRIPTION OF THE DRAWINGS

Other objects and features of the present invention will become apparent from the following detailed description considered in connection with the accompanying drawings which disclose at least one embodiment of the present invention.

It should be understood, however, that the drawings are designed for the purpose of illustration only and not as a definition of the limits of the invention.

In the drawings, wherein similar reference characters denote similar elements throughout the several views:

FIG. 1 shows a front view of the timed alert device;

FIG. 2 shows a back view of a timed alert device that has small solar cell panels;

FIG. 3 shows a back view of a timed alert device that has a battery compartment;

FIG. 4 shows a segment of a windshield, viewed from inside a vehicle, on which a timed alert device is mounted;

FIG. 5 shows a segment of a windshield, viewed from outside a vehicle, on which a timed alert device is mounted;

FIG. 6 shows a flow chart of the electronic processes within the timed alert device;

FIG. 7 shows a side view of the timed alert device mounted on a mounting bracket;

FIG. 8 shows a front view of the timed alert device mounted on a mounting bracket; and FIG. 9 shows a fitted tool for the second actuating element of the timed alert device.

DETAILED DESCRIPTION

Figure 1:
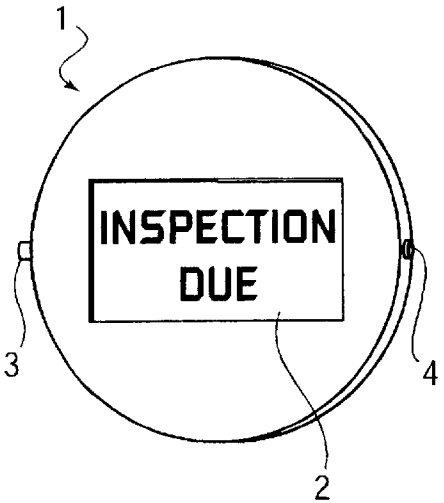

FIG. 1 shows a timed alert device 1. Timed alert device 1 has an visual signal 2 on its front face. In a preferred embodiment there are two timed alert signals, an audible alert and a visual alert. A first actuating element 3 extends from timed alert device 1. First actuating element 3 deactivates the audible alert. Visual signal 2 is preferably an alphanumeric display on an LCD. It may be backlit with orange or red when the visual alert is activated so that the lettering is visible. Visual signal 2 may also count down the number of days remaining until the time period expires.

A second actuating element 4 is disposed on timed alert device 1, opposing first actuating element 3. Second actuating element 4 may be used to deactivate a second timed alert signal. In a preferred embodiment, the second timed alert signal is the visual timed alert signal. Second actuating element 4 may also be used to reset timed alert device 1 for another timing cycle. Alternatively, first actuating element 3 may be used to deactivate both signals and second actuating element 4 may only be used to reset electronic timer 9, or first actuating element 3 may deactivate both signals and reset electronic timer 9.

Additionally, first and second timed alert signals may be deactivated by holding first actuating element 3 or second actuating element 4 down for a specific amount of time. Timed alert device may be reset by holding first actuating element 3 or second actuating element 4 down for a longer period of time.

Figure 2:
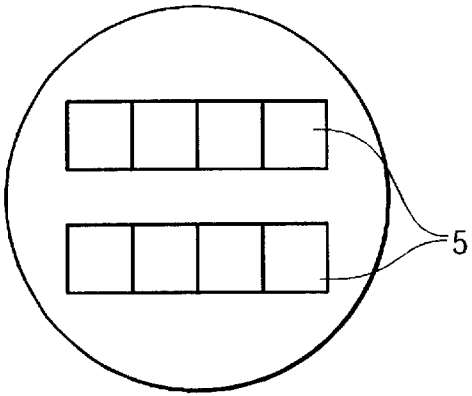
Figure 3:
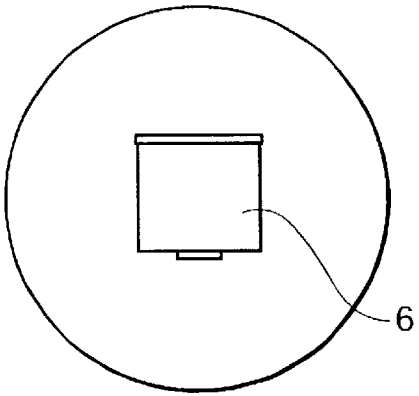

FIG. 2 shows the back of timed alert device 1. Disposed on the back are solar cell strips 5 which collect solar energy needed to power timed alert device 1. Alternatively FIG. 3 shows the back of timed alert device 1 having a battery compartment 6 which would include a battery for powering timed alert device 1.

Figure 4:
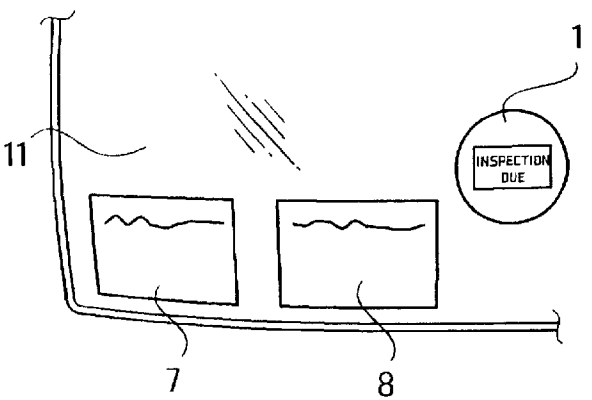
Figure 5:
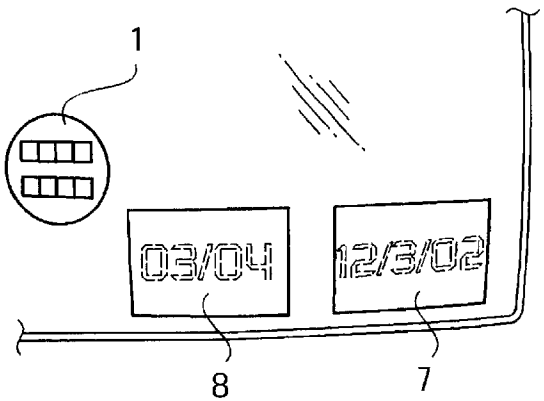

FIG. 4 shows a possible placement of timed alert device 1. Timed alert device 1 can be adhered to the inside of a windshield 11 of a vehicle and placed adjacent to a registration sticker 8 and an inspection sticker 7. Visual signal 2 faces the driver and can only be seen from inside the vehicle. FIG. 5 shows the placement of timed alert device 1 from the outside of windshield 11. Solar cell strips 5 face the outside of the vehicle so that they may collect solar energy to power timed alert device 1. Timed alert device 1 may also be attached to the upper left corner of windshield 11, or on a rearview mirror.

Figure 6:
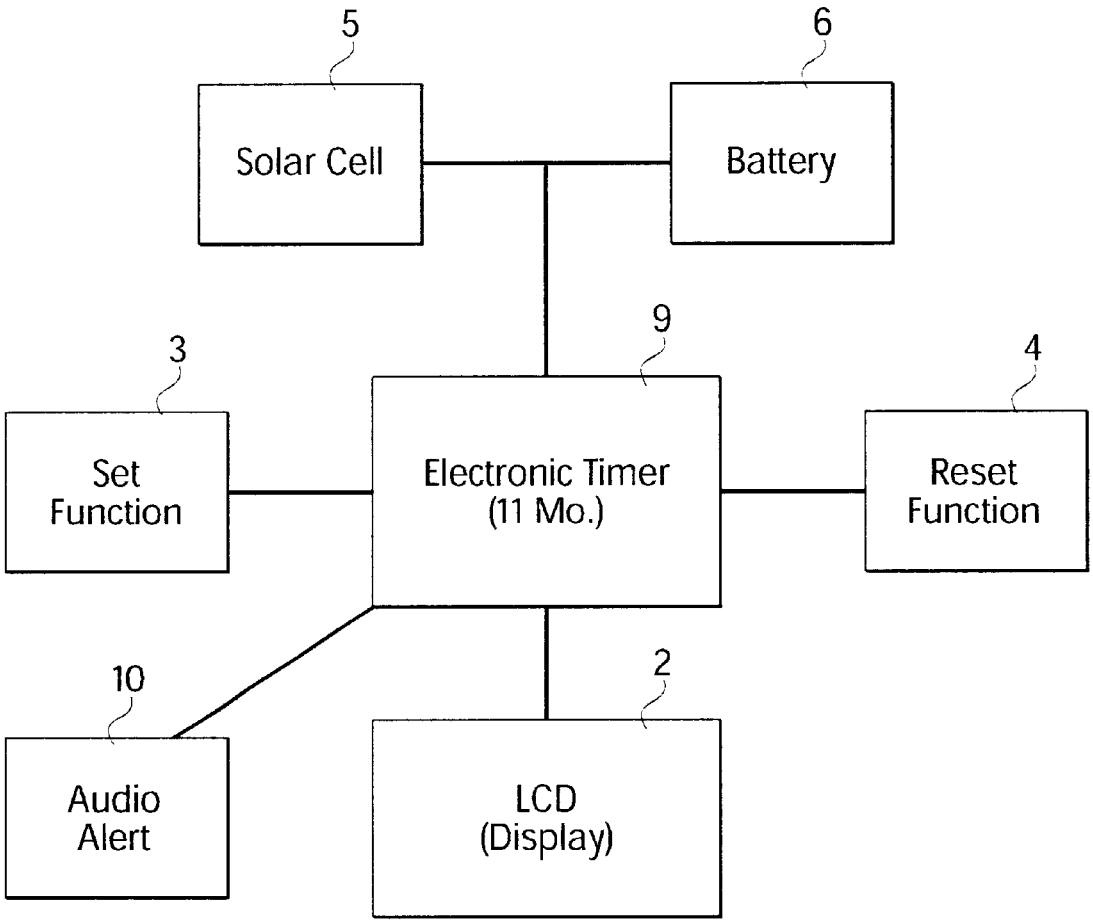

FIG. 6 is a flow chart showing the inner processes of timed alert device 1. Timed alert device 1 obtains power from either solar cells 5 or battery 6. The power feeds an electronic timer 9. Electronic timer 9 is set for a specific time period, which is based on state inspection requirements. A set function 3 involves pressing second actuating element 4. After a prescribed time period an audible alert 10 is activated and is preferably an intermittent beeping. A second alert, backlit visual signal 2, is preferably activated after the time period expires.

FIGS. 7 and 8 show timed alert device 1 mounted on a mounting bracket 14. Mounting bracket 14 is attached to windshield 11 with an adhesive 13. Adhesive 13 may be glue, double sided tape or Velcro. Mounting bracket 14 is tilted so that timed alert device 1 can be easily seen by the driver.

FIG. 9 shows an enlarged view of second actuating element 4 with a fitted tool 12. Second actuating element 4 may be constructed so that visual alert 2 may only be deactivated by using fitted tool 12 with second actuating element 4. This embodiment is most useful when timed alert device is provided by an inspection station, and the inspection station has the tool which deactivates visual alert 2 and resets electronic timer 9. This forces those with timed alert device 1 to get an inspection to shut visual alert 2 off.

Accordingly, while at least one embodiment of the present invention has been shown and described, it is to be understood that many changes and modifications may be made thereunto without departing from the spirit and scope of the invention as defined in the appended claims.

What is claimed is:

1. A timed alert device for vehicles for indicating a timed vehicle event comprising:

a circular housing having a front face, a back face and a surrounding edge;

an electronic timer having a programmable computer chip disposed within said circular housing, wherein said electronic timer clocks a specified time period;

an audible alert generator, disposed in said circular housing and in communication with said electronic timer, wherein said audible alert generator emits a sound when said electronic timer has reached a first prescribed time;

a visual alert indicator disposed on said front face of said circular housing and in communication with said electronic timer, wherein said visual alert indicator activates when said electronic timer has reached a second prescribed time and specifies an amount of days remaining until the timed vehicle event, said visual alert indicator comprising a screen on which a visible message corresponding to the timed vehicle event appears, wherein said screen is backlit when said visual alert indicator is activated;

a first actuating element disposed on the surrounding edge of said circular housing and in communication with said electronic timer, wherein depressing said first actuating element for a specified amount of time both deactivates said audible alert generator and said visual alert indicator;

a second actuating element disposed on the surrounding edge of said circular housing and in communication with the programmable computer chip of said electronic timer for resetting said electronic timer to a new vehicle event, wherein said second actuating element can only be depressed with the use of a specially fitted tool, and wherein said second actuating element must be depressed for a specified amount of time to reset said electronic timer;

a battery disposed in a battery compartment in said back face of said circular housing, and at least one solar cell strip disposed on said back face of said circular housing; said battery and said at least one solar cell strip being coupled to supply power to said electronic timer;

wherein said time period relates to a time period between vehicle events, and said first prescribed time and said second prescribed time are to activate alerts indicating that said timed vehicle event will soon expire.

2. The timed alert device of claim 1 additionally comprising a plastic mounting bracket for fastening to the inside of the vehicle for receiving and supporting said circular housing.

3. The timed alert device of claim 2, wherein said plastic mounting bracket is affixed to a windshield of the vehicle, and is properly tilted so that a driver can see the timed alert device.

4. The timed alert device of claim 1, further comprising an adhesive disposed on said back face of said circular housing that allows the timed alert device to adhere to a windshield of a vehicle.

5. The timed alert device of claim 1, wherein said electronic timer times eleven (11) months.

6. The timed alert device of claim 1, wherein the timed vehicle event is an inspection.

7. The timed alert device of claim 1, wherein the timed vehicle event is registration renewal.

8. The timed alert device of claim 1, wherein the timed vehicle event is an oil change.

9. A timed alert device for vehicles for indicating a timed vehicle event comprising:

a circular housing having a front face, a back face and a surrounding edge;

an electronic timer having a programmable computer chip disposed within said circular housing, wherein said electronic timer clocks a specified time period:

an audible alert generator, disposed in said circular housing and in communication with said electronic timer, wherein said audible alert generator emits a sound when said electronic timer has reached a first prescribed time;

a visual alert indicator disposed on said front face of said circular housing and in communication with said electronic timer, wherein said visual alert indicator activates when said electronic timer has reached a second prescribed time and specifies an amount of days remaining until the timed vehicle event, said visual alert indicator comprising a screen on which a visible message selected from the group consisting of "inspection due", "oil change due" and "registration due" appears, wherein said screen is backlit when said visual alert indicator is activated;

a first actuating element disposed on the surrounding edge of said circular housing and in communication with said electronic timer, wherein depressing said first actuating element for a specified amount of time both deactivates said audible alert generator and said visual alert indicator;

a second actuating element disposed on the surrounding edge of said circular housing and in communication with the programmable computer chip of said electronic timer for resetting said electronic timer to a new vehicle event, wherein said second actuating element can only be depressed with the use of a specially fitted tool, and wherein said second actuating element must be depressed for a specified amount of time to reset said electronic timer;

a battery disposed in a battery compartment in said back face of said circular housing; and at least one solar cell strip disposed on said back face of said circular housing; said battery and said at least one solar cell strip being coupled to supply power to said electronic timer;

wherein said time period relates to a time period between vehicle events, and said first prescribed time and said second prescribed time are to activate alerts indicating that said timed vehicle event will soon expire.

10. A timed alert device for vehicles for indicating a timed vehicle event comprising:

a circular housing having a front face, a back face and a surrounding edge:

an electronic timer having a programmable computer chip disposed within said circular housing, wherein said electronic timer clocks a specified time period;

an audible alert generator, disposed in said circular housing and in communication with said electronic timer, wherein said audible alert generator emits a sound when said electronic timer has reached a first prescribed time;

a visual alert indicator disposed on said front face of said circular housing and in communication with said electronic timer, wherein said visual alert indicator activates when said electronic timer has reached a second proscribed time and specifies an amount of days remaining until the timed vehicle event, said visual alert indicator comprising a screen with the words "inspection due", wherein said screen is backlit when said visual alert indicator is activated;

a first actuating element disposed on the surrounding edge of said circular housing and in communication with said electronic timer, wherein depressing said first actuating element for a specified amount of time both deactivates said audible alert generator and said visual alert indicator;

a second actuating element disposed on the surrounding edge of said circular housing and in communication with the programmable computer chip of said electronic timer for resetting said electronic timer to a new vehicle event, wherein said second actuating element can only be depressed with the use of a specially fitted tool, and wherein said second actuating element must be expressed for a specified amount of time to reset said electronic timer;

a battery disposed in a battery compartment in said back face of said circular housing; and at least one solar cell strip disposed on said back face of said circular housing; said battery and said at least one solar cell strip being coupled to supply power to said electronic timer;

wherein said time period relates to a time period between vehicle events, and said first prescribed time and said second prescribed time are to activate alerts indicating that said timed vehicle event will soon expire.

* * * * *